US009702083B2

(12) United States Patent
Fatehi et al.

(10) Patent No.: US 9,702,083 B2
(45) Date of Patent: Jul. 11, 2017

(54) USE OF FLY ASH TO TREAT SPENT LIQUOR FROM A THERMOMECHANICAL PULPING PROCESS

(71) Applicant: Lakehead University, Thunder Bay (CA)

(72) Inventors: Pedram Fatehi, Thunder Bay (CA); Farshad Oveissi, Thunder Bay (CA)

(73) Assignee: LAKEHEAD UNIVERSITY, Thunder Bay, Ontario (CA)

( * ) Notice: Subject to any disclaimer, the term of this patent is extended or adjusted under 35 U.S.C. 154(b) by 0 days.

(21) Appl. No.: 14/976,022

(22) Filed: Dec. 21, 2015

(65) Prior Publication Data

US 2016/0222587 A1 Aug. 4, 2016

Related U.S. Application Data

(60) Provisional application No. 62/109,433, filed on Jan. 29, 2015.

(51) Int. Cl.
*D21C 11/00* (2006.01)

(52) U.S. Cl.
CPC ..... *D21C 11/0085* (2013.01); *D21C 11/0007* (2013.01); *Y10S 162/08* (2013.01)

(58) Field of Classification Search
CPC ..... D21C 11/0007
See application file for complete search history.

(56) References Cited

U.S. PATENT DOCUMENTS 5,405,502 A * 4/1995 Palmu ..... D21C 11/12 162/239
8,617,357 B2 * 12/2013 Dionne ..... B30B 9/243 162/336

OTHER PUBLICATIONS

Srivastava et al., Treatment of pulp and paper mill wastewaters with poly aluminium chloride and bagasse fly ash, 2005, Colloids and Surfaces A:Physiochem. Eng. Apsects 260, p. 17-28.*
Bursey et al., Overfire air system improves biomass stoker boiler operation, 2011, Proc Aust Soc Sugar Cane Technol, vol. 11.*
Hurter Robert, Developments in pulp and paper manufacture from sugarcane bagasse, 2007, Queensland University of Technology.*
Gillies Randall, Utilization of Fly ash for treatment of Pulp Mill Effluent, 1975, University of Saskatchewan.*
Oveissi et al., Extracting Lignicelluloses from Various Spent Liquors via Absoprtion, Chapter 4: Impact of Power Boiler Fly Ash on Properties of Spent Liquor of TMP Process, Sep. 10, 2014, Graduate Thesis Lakewood University.*

* cited by examiner

*Primary Examiner* — Anthony Calandra
(74) *Attorney, Agent, or Firm* — Kyle R. Satterthwaite; Ryan W. Dupuis; Ade & Company Inc.

(57) ABSTRACT

The spent liquor (SL) of a thermomechanical pulping (TMP) process introduces a high load to the wastewater system of this process. To reduce this load, fly ash from a biomass boiler is used for removing lignin from the SL, and also for decreasing the chemical oxidation demand (COD) and turbidity of the SL.

16 Claims, 6 Drawing Sheets

USE OF FLY ASH TO TREAT SPENT LIQUOR FROM A THERMOMECHANICAL PULPING PROCESS

CROSS REFERENCE TO RELATED APPLICATIONS

This application claims benefit under 35 U.S.C. 119(e) of Provisional Application Ser. No. 62/109,433, filed Jan. 29, 2015.

FIELD OF THE INVENTION

The present invention relates generally to thermomechanical pulping processes, and more particularly to the application of fly ash to the spent liquor from such processes.

BACKGROUND OF THE INVENTION

The pulp and paper industry is one of the main industries contributing to the gross domestic products (GDP) of Canada and the USA due to their enormous forest resources. However, the pulp and paper industry is currently struggling financially due to strong competition from countries with low labor costs. One strategy to reduce the production costs, and thus to increase the economic benefits of the pulp and paper industry is to utilize their wasted materials more effectively.

The amount of wastewater generated in the pulp and paper industry was estimated as half of all waste effluents released to surface water in Canada. Recently, the capital cost for a lignocellulosic-based wastewater plant with a hydraulic load of 2.15 MMgal/d was estimated to be $49.4 million and the annual chemical cost for this plant was predicted to be $2.83 million.

In the thermomechanical pulping (TMP) process, wood chips are pretreated with steam, which extracts some organic materials, including lignin from wood, and dissolves it in pressate (i.e. the spent liquor (SL) of this process). This extract is sent to a wastewater treatment plant in order to remove the suspended solids and dissolved organic material prior to its discharge. Lignin of SL can be used in the production of value-added products such as carbon fiber, epoxy resins and adhesives. Alternatively, lignin has a heating value of 27 MJ/kg, which equivalently worth $100-300 per oven dry metric ton. Possessing such a high heating value would make lignin as an alternative fuel.

It has been stated that the main source of chemical oxidation demand (COD) of SL is dissolved lignin and its derivatives. In this regard, the COD reduction of lignocellulosic-based wastewater effluent was the subject of several research projects. It has been claimed that, within two stages of anaerobic reactors, 90% of COD from SL was removed at hydraulic retention time of 21 h. Although biological methods are efficient in removing COD, the treated wastewater has color, as not all lignocelluloses will decompose by biological treatments. To improve the COD removal from TMP wastewater, the co-digestion of lignocelluloses with glucose using thermophilic acidogens was suggested in anaerobic reactors. The main disadvantage of such process is the decomposition and thus wasting of the dissolved lignocelluloses in wastewater. In other words, the biological treatment improved the COD removal from wastewater at the expense of decomposing lignocelluloses. Coagulation with metal salts and polymers (mostly anionic) was proposed to improve the removal of lignocelluloses and COD from SL. In one study, the aerobic fermentation of effluent of alkaline peroxide mechanical pulping (APMP) with *Aspergillus niger* showed 30% COD reduction via adding 1000 mg/l alum, as a coagulant, and 2 mg/l cationic polyacrylamide (CPAM), as a flocculant. In a similar study, almost 90% of COD was removed by adding 4.5 mg/l aluminum sulfate and 2 mg/l CPAM from the secondary treatment of a wastewater effluent. Although coagulation and flocculation treatments are more effective than biological processes for removing lignocelluloses and COD, their operating cost is significant.

Adsorption was regarded as a fast, selective and economical method for lignin removal from spent liquors. In one study, a two stage adsorption process (using activated carbon with the dosage of 1 g activated carbon per 90 g of SL) reduced the lignin, COD and turbidity of SL of TMP by 60%, 32%, 39%, respectively. Fly ash is produced in solid fuel boilers by burning wood residuals, bark or coal. In prior literature, the utilization of fly ash for adsorption of NOx, SOx and several organic compounds (i.e. phenols) from wastewater effluents and air was discussed. It was stated that up to 90% of lignin was removed from a bleaching effluent of a TMP process by treating with 50 g/l fly ash generated in a steam-producing boiler.

Applicant has performed the first study on the application fly ash to the SL of a TMP process. The main focus of the study is on the changes in the COD, turbidity and lignin removals of pulping spent liquor via treatment with fly ash. In this work, operating conditions (treatment time and dosage of fly ash) for removals of lignin, COD and turbidity was optimized. Subsequently, the impact of a two stage process on treating SL was studied under various conditions. Based on the results, an integrated process was proposed not only for decreasing the load to wastewater system, but also for using treated fly ash as a fuel source in the biomass boiler in an effort to improve the energy balance of the TMP process.

SUMMARY OF THE INVENTION

One aspect of the invention is use of fly ash to treat spent liquor from a pulping process.

Another aspect of the invention is use of fly ash to reduce lignin content of spent liquor from a pulping process.

Another aspect of the invention is use of fly ash to reduce a turbidity level of spent liquor from a pulping process.

Another aspect of the invention is use of fly ash to reduce a chemical oxidation demand of spent liquor from a pulping process.

Another aspect of the invention is use of fly ash to reduce one or more of chemical oxidation demand, lignin content and turbidity of spent liquor from a pulping process.

According to yet another aspect of the invention, there is provided a method of treating spent liquor from a pulping process of a pulp mill, the method comprising applying fly ash to the spent liquor.

Preferably the method comprises locally sourcing the fly ash from a boiler of the pulp mill.

Preferably the method comprises, after treatment of the spent liquor with the fly ash, separating said fly ash from the spent liquor and using said ash as a boiler fuel source.

Preferably the method comprises using the separated fly ash as the boiler fuel source for the same boiler from which the fly ash was sourced.

Preferably the method comprises, after using said separated fly ash as the boiler fuel source, reusing said separated fly ash in an additional spent liquor treatment step.

Preferably the method comprises applying the separated fly ash to the additional spent liquor treatment step via a recirculation loop of a process flow path of the pulp mill.

Preferably the method comprises a step of increasing a dryness of the separated fly ash prior to use of the separated fly ash as the boiler fuel source.

Preferably the step of increasing the dryness of the separated fly ash comprises performing a pressing operation on the separated fly ash.

Preferably the method comprises, after treatment of the spent liquor with the fly ash, performing a second treatment of the spent liquor by applying a second dose of fly ash thereto.

Preferably the method comprises separating the spent liquor from the fly ash prior to the second treatment of the spent liquor with the second dose of fly ash.

Preferably all the fly ash, including the second dose thereof, is obtained from a same source.

Preferably the method comprises reducing a pH level of the spent liquor prior to delivery of the spent liquor to a wastewater treatment area for further treatment.

Preferably the method comprises reducing the pH level of the spent liquor subsequent to treatment thereof with the fly ash.

Preferably the method comprises reducing a pH level of the spent liquor.

Preferably the method comprises mixing the fly ash-treated spent liquor with other untreated wastewater of the mill prior to a subsequent biological treatment of the mixture.

Preferably the method comprises reducing the pH level of the spent liquor subsequent to treatment thereof with the fly ash.

In one embodiment, the step of reducing the pH level comprises reducing the pH level to an original pH value of the spent liquor prior to the treatment thereof with the fly ash.

The forgoing methods may be used for reducing any one or more of chemical oxidation demand, lignin content and turbidity of spent liquor from a pulping operation.

According to another aspect of the invention, there is provided a method of treating spent liquor from a pulping process of a pulp mill, the method comprising treating spent liquor from a steam pretreatment stage of a thermomechanical pulping process with fly ash obtained from a bark boiler, wherein said fly ash is applied to said spent liquor at a wastewater pretreatment stage upstream from a biological wastewater treatment stage to which the pretreated spent liquor is subsequently subjected.

DETAILED DESCRIPTION OF PREFERRED EMBODIMENTS

As outlined herein further below, testing by the applicant has demonstrated that the application of the fly ash to the spent liquor from a pulping process is effective to reduce the chemical oxygen demand (COD), lignin content and turbidity level of the spent liquor. This novel application has numerous potential benefits. Conventionally, wastewater samples and spent liquors are mixed together and then chemicals, e.g. alkali, are added so that the mixture has the appropriate conditions that are required in the biological treatment of wastewater systems in industry. However, since fly ash itself has some levels of alkalinity, the novel addition of fly ash to the spent liquor will eliminate or reduce the need for other chemicals to pretreat the spent liquor/effluent mixture prior to the biological treatment, thereby reducing chemical costs associated with conventional treatment. The organic compounds of spent liquors will be adsorbed on the fly ash. Once the post-treatment fly ash is removed, the treated spent liquors have less organic load, and thus the overall load to the wastewater treatment process would be reduced, thereby further reducing the overall cost of the wastewater treatment. The post-treatment fly ash can be incinerated in the boiler of the process, which generates some net heat as a result of incinerating the organics that were adsorbed thereon. The re-incinerated fly ash can be recycled in the system, i.e. used in another round of spent liquor treatment.

Figure 5:
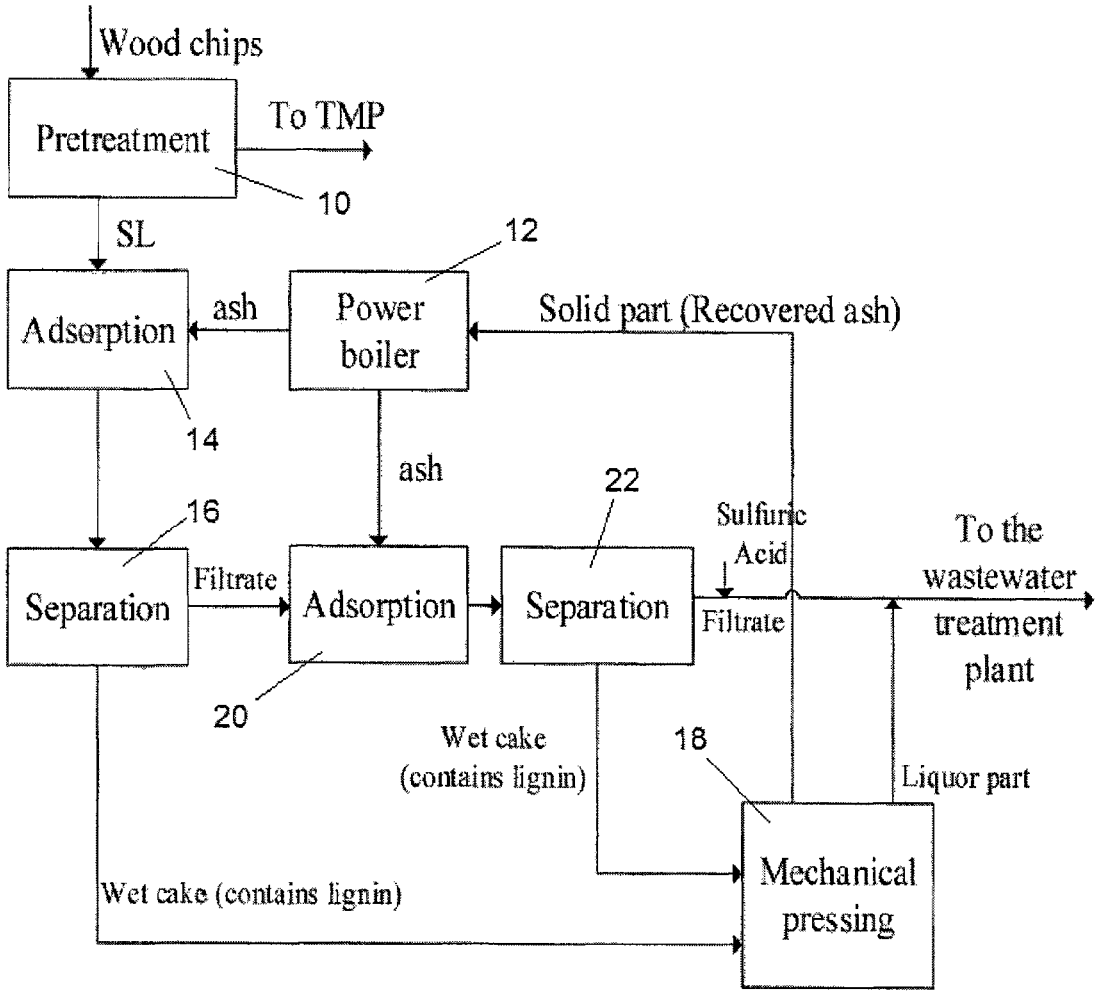
FIG. 5 is a flow chart illustration of a pulp mill process for fly ash treatment of spent liquor from a thermomechanical pulping process.

FIG. 5 illustrates one embodiment of a fly ash treatment process. In this process, the spent liquor of a thermomechanical pulp process is treated via two step adsorption stages. The treated fly ash is separated from a filtrate in each adsorption stage, then the fly ash from both adsorption stages are combined together and sent to a mechanical press to increase its dryness. Once the water content of the treated fly ash is reduced, it will be sent to the power boiler. After incineration in the power boiler, the dried fly ash will be recirculated to the adsorption stages. The lignocellulosic materials attached to fly ash will ideally generate a net heat in the power boiler, hence it will help the overall economy of the plant. Consequently, not only is the power boiler integrated into the spent liquor treatment process (and lignocelluloses will be more effectively utilized), but also the load to wastewater treatment will be reduced significantly. This can provide an important distinction and advantage over the conventional process, as the anaerobic, aerobic and polymer treatments currently used in the art are expensive. The developed process is environmentally friendly, simple and well integrated into the existing facilities of pulping processes.

Outlining the spent liquor treatment process of FIG. 5 in more detail, the thermomechanical pulping (TMP) process starts in a conventional manner, with wood chips being pretreated with steam at pretreatment stage 10, which extracts some organic materials, including lignin, from the wood, and dissolves it in pressate (i.e. the spent liquor (SL) of this process). From the pretreatment stage 10, the treated wood chips continue on to other stages of the TMP process, which may be conventional and are not the subject of the present invention. A first dose of fly ash sourced from the power boiler 12 of the pulp mill is added to, and mixed with, the spent liquor SL from the pretreatment stage 10 at a first adsorption-based treatment stage 14. The spent liquor and added fly ash are maintained in mixture for a period of time, allowing the lignin of the spent liquor to be adsorbed on the fly ash. After this first treatment stage 14, a wet cake containing the ash and adsorbed lignin is filtered and separated out from the treated spent liquor in a first separation stage 16.

From the first separation stage 16, the lignin-containing wet cake is transferred to a mechanical press 18, where the wet cake is pressed in order to increase the dryness of the post-treatment fly-ash and lignin combination by squeezing out liquid content therefrom. The spent liquor filtrate from the first treatment and separation stages 14, 16 proceeds to a second adsorption-based treatment stage 20, where a second dose of fly ash from the power boiler 12 is added to the spent liquor filtrate from the first treatment stage 14. This mixture is again maintained for a period of time, allowing more of the lignin remaining in the spent liquor filtrate to be adsorbed on the second dose of fly ash. After this second treatment stage 20, the treated spent liquor filtrate is subject to a second separation stage 22, which again filters and separates out a wet cake that contains the second dose of fly ash and the lignin adsorbed thereon. The second source of wet cake resulting from this second separation stage is likewise delivered to the mechanical press 18 for a drying operation.

The spent liquor filtrate from the second separation stage 22 is fed onward to a wastewater treatment stage, the load and resulting chemical requirements of which are reduced as a result of the two fly ash treatment stages already performed on the spent liquor. The dried out ash and lignin solids from the press 18 are then fed back into the power boiler 12 as a fuel source for same, where the burning of the lignin in the recovered fly ash from the two separation stages acts to reduce the fresh fuel requirements for the boiler, thereby powering the pulp mill more efficiently. The sourcing of the fly ash for the two treatment stages from the same boiler to which the recovered fly ash is delivered as a boiler fuel source results in a recirculation loop by which the recovered fly ash is used again in subsequent performances of the spent liquor treatment steps. Accordingly, after treatment of a first batch of spent liquor, subsequent treatments may employ a combination of newly incinerated pre-treatment fly ash and reused post-treatment fly ash that has now been incinerated a second time in the power boiler after recovery from the spent liquor treatment stages.

Figure 1:
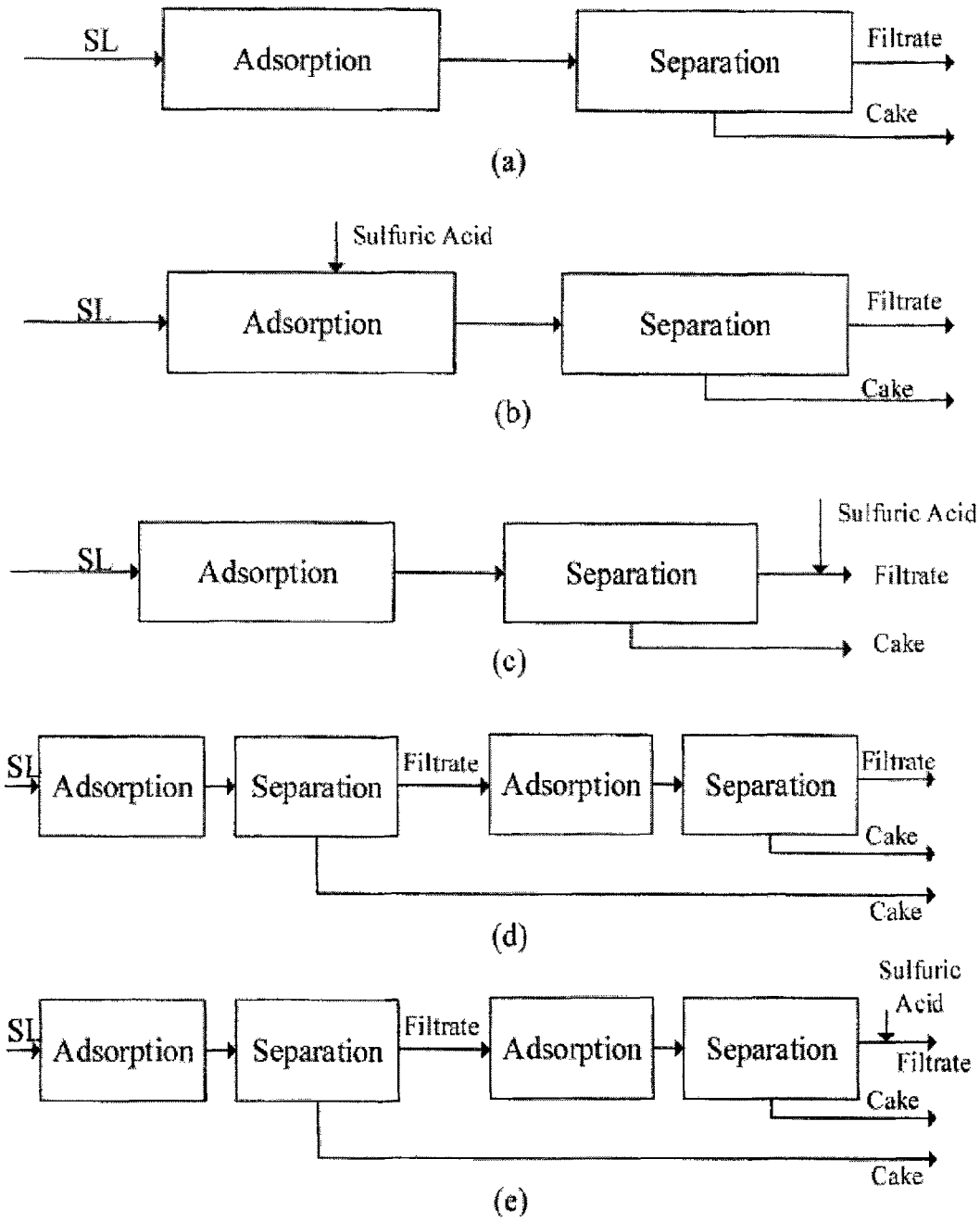
FIG. 1 schematically illustrates alternative processes for treatment of TMP spent liquor using fly ash, including (a) one stage adsorption, (b) one stage adsorption with pre-treatment pH adjustment, (c) one stage adsorption with post-treatment pH adjustment, (d) two-stage adsorption, and (e) two-stage adsorption with post-treatment pH adjustment.
Figure 2A:
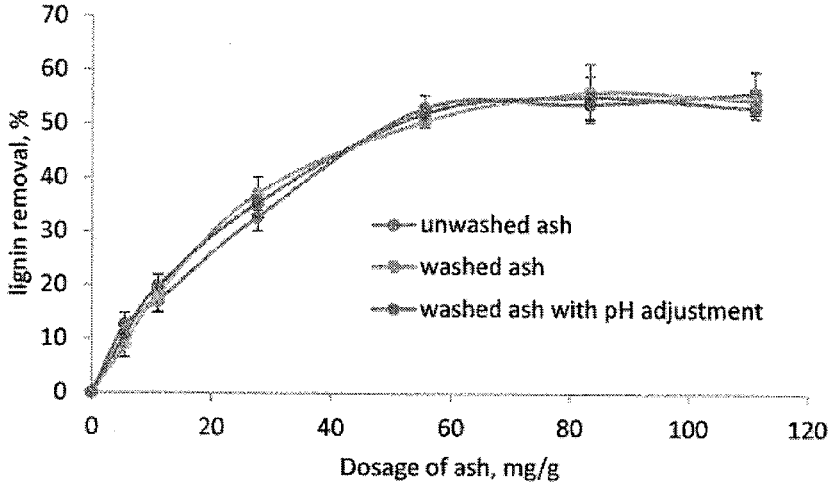
FIG. 2A graphically illustrates the effect of the dosage of fly ash (unwashed, washed and washed fly ash with post-pH adjustment) to spent liquor ratio on reduction of lignin and chemical oxygen demand of the spent liquor, as testing by adding 1 g of unwashed and washed fly ash to 45 g of SL at 30° C., 100 rpm for 3 h).
Figure 2A:
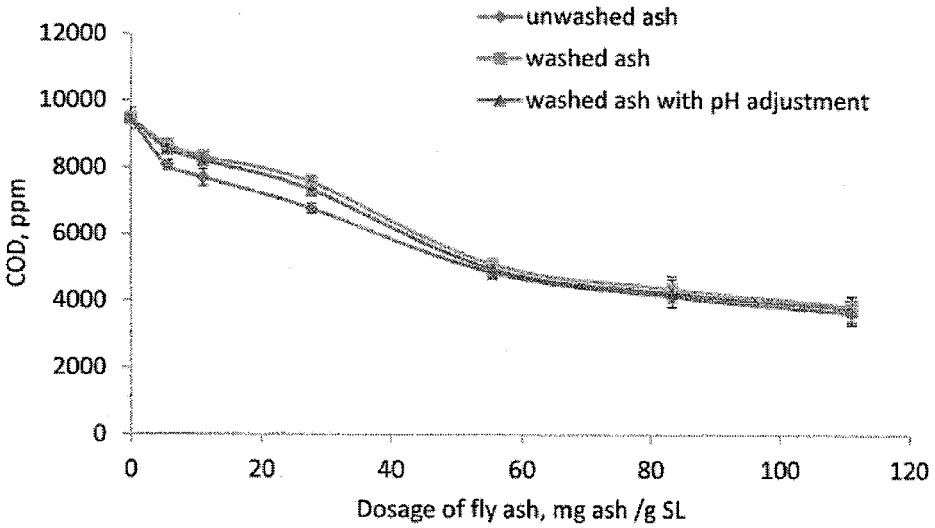
Figure 2B:
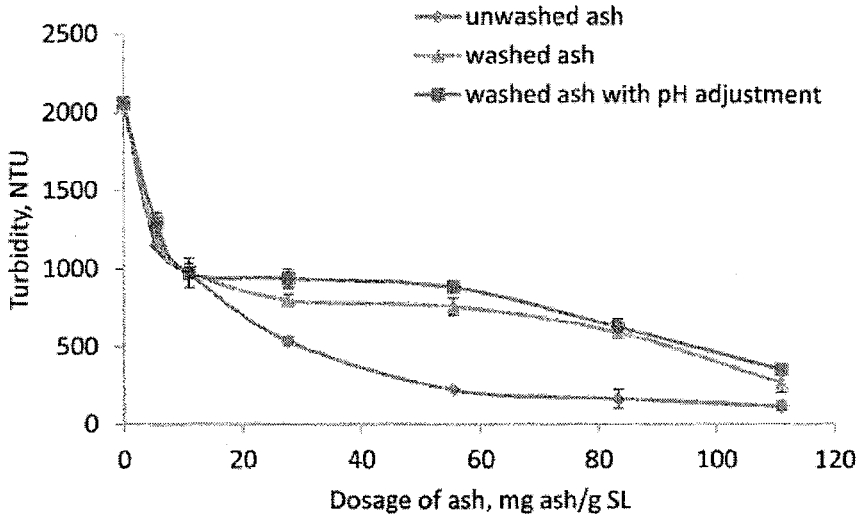
FIG. 2B graphically illustrates the effect of the dosage of fly ash (unwashed, washed and washed fly ash with post-pH adjustment) to spent liquor ratio on the turbidity and pH of the spent liquor (conducted via adding 1 g of unwashed and washed fly ash to 45 g of SL at 30° C., 100 rpm for 3 h).
Figure 2B:
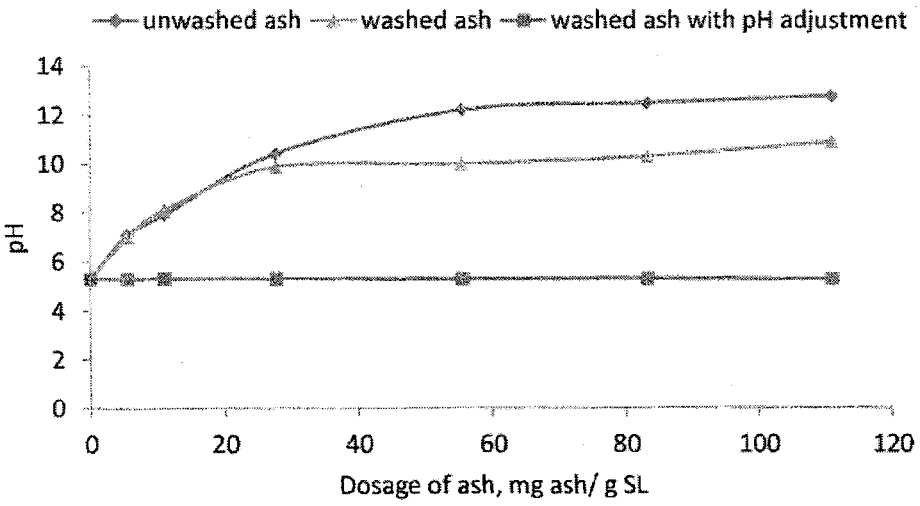

While FIG. 5 illustrates one particularly preferred embodiment that features two-stage treatment of the spent liquor and re-use of the post-treatment fly ash, more simplistic processes may alternatively be employed in other embodiments of the present invention. FIGS. 1(*a*), 1(*b*) and 1(*c*) illustrate single stage processes, each having only one treatment/adsorption step with a single corresponding separation step, and differing only the inclusion or absence of a pH-adjustment step and location of such step. FIG. 1(*a*) lacks any pH-adjustment step. FIG. 1(*b*) provides for reduction of the pH level at the treatment stage by adding sulfuric acid or other acidic agent to the spent liquor and fly ash at the start of the treatment stage, while FIG. 1(*c*) applies the pH reduction step to the post-treatment spent liquor filtrate. FIGS. 1(*d*) and 1(*e*) each feature a two stage treatment process with two treatment stages and two respective separation stages, Like FIG. 5. FIG. 1(*e*) includes performance of a post-treatment pH adjustment step to the spent liquor filtrate after the second treatment and separation stages, while FIG. 1(*d*) lacks any pH adjustment step. Any of the treatment options illustrated in FIG. 1 may be used within the larger process of FIG. 5.

Any of the single or multi-stage processes may optionally omit the recirculation loop by which post-treatment fly ash is dried and returned to the same boiler from which the pre-treatment fly ash was originally sourced. In such cases, the drying stage may optionally still be performed on the recovered fly ash, for example to enable burning of same in a different boiler other than that from which the treatment fly ash was originally sourced. The recovered fly ash may be dried by means other than mechanical pressing of same. Although the embodiment of FIG. 5 sources the fly ash from the power boiler of the pulp mill, other sources of fly ash may be relied upon to feed the spent liquor treatment process, including other boilers that may be employed elsewhere in the pulp mill. Use of an existing boiler of the conventional pulp mill process provides convenient on-site supply of the fly ash, and makes use of an existing byproduct of the conventional process in order to reduce waste.

Optionally, the fly ash and spent liquor may be mixed or agitated continually or periodically during the fly ash treatment stages, although the fly ash treatment is expected to be effective even in embodiments without a mixing action (in which spent liquor passes though fly ash). The fly ash treatment of the spent liquor can be conducted in a clarifier, in which case the treated fly ash may settle and collected with sludge of the clarifier, or the treatment can be conducted in a continuous flow stirred-tank reactor (CSTR) type vessel, in which case the treated fly ash may be separated from treated spent liquor with a filter.

Having described preferred embodiments of the present invention, experimental results demonstrating the functional principles of the present invention are now summarized as follows.

1. Materials and Methods 1.1. Materials

Fly ash was collected from a bark boiler of a pulp mill in Northern Ontario, Canada, and ground to be homogeneous. The spent liquor (SL) of a thermomechanical pulping (TMP) process was received from the same mill and used as received.

1.2. Elemental Analysis

The metal content of fly ash was measured using inductively coupled plasma atomic emission spectroscopy (ICP-AES) with CETAC ASX-510 Auto Sampler (Canada). The ICP-AES analysis was conducted via using Varian Vista Pro CCD (Canada) according to the method established in the literature. Elemental (ultimate) analysis was performed using a Vario EL cube instrument (Germany) according to the procedure described by Fadeeva et al. (18).

1.3. Surface Area and Charge Density

The BET surface area of fly ash was determined using a NOVA-2200e Autosorb under $N_2$ atmosphere according to a previously established method described by Yang et al. (19). The charge density of fly ash was determined by using Mtitek PCD04 charge detector as previously described by Oveissi et al. and Liu et al. (15, 20).

1.4. Single Stage Adsorption Process

In one set of experiments, different amounts of fly ash were added to 45 g of SL samples in 125 ml Erlenmeyer flasks. Then, all flasks were sealed and incubated in a Boekel water bath shaker at 30° C. and 100 rpm for 3 h. This set of experiments helped optimize the dosage of fly ash in SL (i.e. the dosage that induced the maximum removals of lignin, COD and turbidity). Based on these results, the treatment time of adsorption was investigated at various time intervals at 100 rpm. In this set of experiments, control samples were prepared under the same conditions as treated SL, but without fly ash. The temperature of this experiment was fixed at 30° C., as an earlier study previously showed that the adsorption of lignin on activated carbon was the maximum at 30° C. Subsequently, the treated SLs were centrifuged at 1000 rpm for 10 min using Survall STI 6 centrifuge. The filtrates were collected for lignin, COD and turbidity analyses. To satisfy statistical consistency, all tests repeated three times and the average of three repetitions was reported in this study. The error bars in all figures accounts for standard deviations of each triplicate.

Alternatively, fly ash was washed with deionized water (incubated at 30° C., 100 rpm for 24 h), then dried. Different amounts of washed fly ash were added to SL and samples were centrifuged at 1000 rpm for 10 min. This set of experiments was conducted to investigate the effect of fly ash impurity (e.g. metal ions) on lignin, COD and turbidity removals.

1.5. Removal Alternatives

To find the maximum removals of lignin, COD and turbidity from SL, the various processes depicted in FIG. 1 were studied. In option A, 2.5 g of fly ash was added to 45 g of SL and shaken at 100 rpm and room temperature for 3 h. In option B, the pH of SL samples was set to 5.3 (i.e. pH of original SL) after adding fly ash, but before incubation. In option C, sulfuric acid (4 wt. %) was added after adsorption treatment to adjust the pH of the treated effluent after separation. It should be stated that for comparing various treated SL samples, the pH was adjusted to the pH of original SL (pH 5.3).

In option D, the SL that was already treated with fly ash was re-treated with fresh fly ash under the same optimal conditions in order to further reduce the organic material from the effluent without any pH adjustment. In option E, the two stage adsorption was performed with the pH adjustment step after the treatment. The filtrates of these processes were analyzed and compared with original effluent.

1.6. Lignin Analysis

The lignin content of all solutions was determined by UV/Vis spectrophotometry, Genesys 10S, at the wavelength of 205 nm according to TAPPI UM 250. Calibration curves were generated and the average of three testing results was reported. To confirm that there is no interaction between fly ash and water, 2.5 g of fly ash was added to 45 g of deionized water and incubated overnight at 30° C., 100 rpm (i.e. control sample). After separation, the filtrate was collected and its UV adsorption was scanned at the wavelength of 205 nm in order to confirm that there was no interference from fly ash in lignin analysis using UV/Vis spectrophotometry.

1.7. Turbidity and Chemical Oxygen Demand (COD) Analyses

The turbidity of SL samples was assessed before and after the adsorption experiments using a Hach 2100AN turbidity meter. This procedure was repeated three times and the average values were reported. The chemical oxygen demand (COD) of SL samples before and after fly ash treatment was measured as previously described, and the average values of three repetitions were reported in this work.

1.8. Calorific Value

Gross calorific heating value was measured by a PARR 6200 oxygen bomb calorimeter, according to ASTM E711-87.

2. Results and Discussion 2.1. Ash Characterization

Table 1 shows the properties of unwashed and washed fly ash. Evidently, fly ash contained 30 wt. % metals, such as calcium, potassium, magnesium and aluminium, which may create fly ash as a potential coagulant for effluent treatment. These metals were also reported as the most common constituents of fly ash in the literature. By washing fly ash, the weight percentage of potassium, sodium, sulfur in fly ash decreased by 3.36%, 0.55% and 2.16%, respectively. However, weight percentages of carbon and oxygen increased by 2.12% and 2.58%, respectively. The shares of other constituents in fly ash were not significantly changed by washing.

TABLE 1

Elemental Analysis of Fly Ash

| Element | Unwashed fly ash, wt. % | Washed fly ash, wt. % | Element | Unwashed fly ash, wt. % | Washed fly ash, wt. % |
|---|---|---|---|---|---|
| Calcium | 14.60 | 14.51 | Phosphorus | 0.87 | 0.92 |
| Potassium | 4.06 | 0.70 | Manganese | 0.33 | 0.38 |
| Magnesium | 1.96 | 2.01 | Zinc | 0.19 | 0.21 |
| Aluminum | 0.99 | 1.03 | Silicon | 0.08 | 0.13 |
| Sodium | 0.93 | 0.38 | Sulfur | 4.60 | 2.44 |
| Iron | 0.89 | 0.84 | Carbon | 34.60 | 36.72 |
| Oxygen | 26.33 | 28.91 | Hydrogen | 1.59 | 1.79 |
| Nitrogen | 0.14 | 0.14 | | | |

Table 2 lists the surface area and charge density of unwashed and washed fly ash samples. As can be seen, unwashed fly ash had 35 μeq/g of cationic charge density, while washed fly ash had 17.2 μeq/g of cationic charge density. The anionic charge density of fly ash was negligible before and after washing. Decrease in cationic charge density of fly ash through washing might be due to the decrease in the metal component of fly ash such as potassium and sodium. Based on the Brunauer-Emmett-Teller equation, the surface area for unwashed and washed fly ash was determined as 63.72 and 90.2 $m^2/g$, respectively. It can be inferred that washing either removed the large metal components from fly ash or opened the structure of fly ash (i.e. improved the porosity of fly ash). In the literature, it was claimed that fly ash, obtained from Obra thermal power station, had a surface area of 4.87 $m^2/g$. In another study, 1.5-1.7 $m^2/g$ was as the surface area of fly ash received from Poplar River power station operated by the Saskatchewan Power Cooperation.

TABLE 2

Charge Density and Surface Area of Fly Ash

| Charge density (μeq/g) | Unwashed fly ash | Washed fly ash |
|---|---|---|
| Anionic | 0.00 | 1.83 |
| Cationic | 35.01 | 17.17 |
| BET surface area ($m^2/g$) | 63.7 | 90.2 |

2.2. Adsorption on Unwashed Fly Ash

FIG. 2 shows the change in the lignin, COD, turbidity and pH of SL after treating with fly ash as a function of the ratio of fly ash to SL. It is evident that, as fly ash content increased, the lignin removal from the SL increased. The increase in lignin removal was due to the adsorption of lignin on fly ash. At the dosage of 55 mg/g fly ash/SL, lignin removal reached the maximum amount (53%), which corresponded to the lignin adsorption of 67 mg/g on fly ash. In another study, 67 mg/g of phenolic compounds (with various initial concentrations ($C_0$)) was adsorbed on fly ash generated by a power generator in the effluent containing phenol, 3-chlorophenol and 2,4-dichlorophenol. In another study, by adding 100 mg of fly ash generated by a steam boiler to 50 g/L of bleaching effluent of a TMP process (stirred at 200 rpm for 6 h), 5 mg/g of lignin was adsorbed on fly ash.

It is also apparent in FIG. 2 that the COD level of SL decreased by increasing fly ash ratio. As can be observed, at 55 mg/g fly ash/SL ratio, almost 50% (4728 ppm) of COD was removed. It was claimed that lignin-related substances significantly contributed to COD content of pulping effluent. Hence, decrease in COD could be attributed to the reduction in lignin content of SL.

As can be seen, by increasing the dosage of fly ash, turbidity of SL significantly decreased and it reached a plateau of 220 NTU (89% turbidity removal). The decrease in turbidity removal can be attributed to two phenomena of adsorption and coagulation. 1) Lignin concentration in SL decreased as it was adsorbed on fly ash (i.e. adsorption); 2) It was claimed that lignin of pulping effluent had carboxylic groups, which implies that lignin had an anionic charge density. Lignin and other anionic components of SL would be neutralized by fly ash metals (such as $Ca^{2+}$, $Al^{3+}$, $Fe^{2+}$ and $Fe^{3+}$). The hydrolysis of metals and subsequent precipitation of metal hydroxides and other metal-lignocellulosic compounds would contribute to the decrease in the turbidity of SL (i.e. coagulation). Additionally, the pH of samples increased by adding fly ash. It was discussed in prior literature that most fly ashes are alkaline due to their alkali and alkaline earth metal compounds. Increasing pH of the SL may be due to the hydrolysis of fly ash constituents (mainly metals) in SL.

2.3. Adsorption on Washed Fly Ash

FIG. 2 also shows lignin, turbidity and COD removals as a function of the dosage of washed fly ash (mg/g) with and without pH adjustment. As can be seen, washing fly ash insignificantly affected the removal of lignin. In this case, an increase in the surface area of fly ash through washing (Table 2) compensated for the decrease in cationic charge density of fly ash. In other words, the overall adsorption might have been increased, while the overall coagulation might have been decreased in treating SL with washed fly ash compared unwashed fly ash, which implies that washing fly ash had inconsiderable effect on adsorption of lignin.

The COD and turbidity analyses (FIG. 2) showed that the treatment with washed fly ash had less COD and turbidity reductions compared to the treatment with unwashed fly ash treatment. As explained earlier, by washing fly ash, the metal components of fly ash decreased, and thus its coagulating performance was reduced. The reduction in coagulating performance of fly ash would reduce its affinity in removing other components of effluent (i.e. extractives and fatty acids). It should be highlighted that the difference in end pH of SL between unwashed and washed fly ash is due to the reduction in metal ions (mainly sodium and potassium) and thus alkalinity of fly ash through the washing process.

2.4. Kinetics of Adsorption

Figure 3:
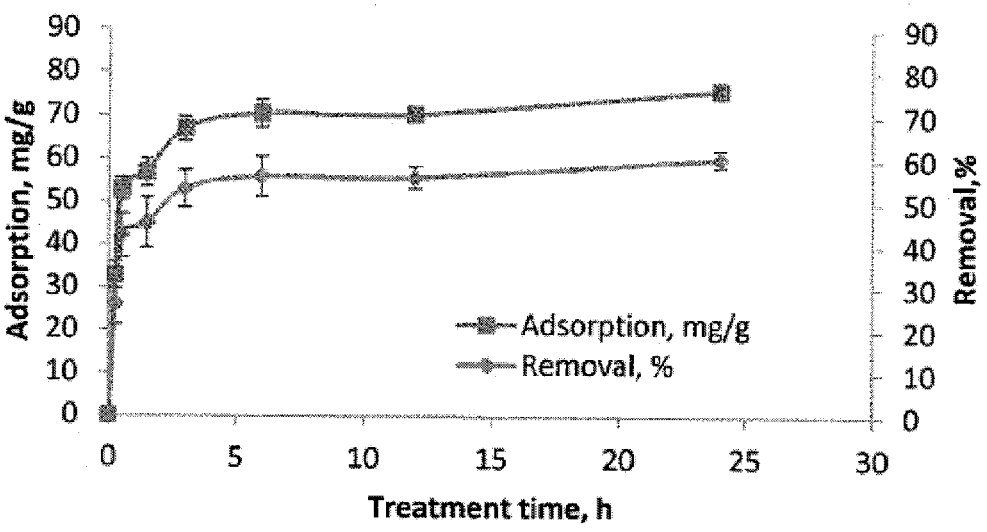
FIG. 3 graphically illustrates the effect of treatment time on the adsorption of lignin on fly ash and reduction of chemical oxygen demand and turbidity in the spend liquor (conducted at the fly ash/spent liquor ratio of 55 mg/g at 30° C. and 100 rpm)
Figure 3:
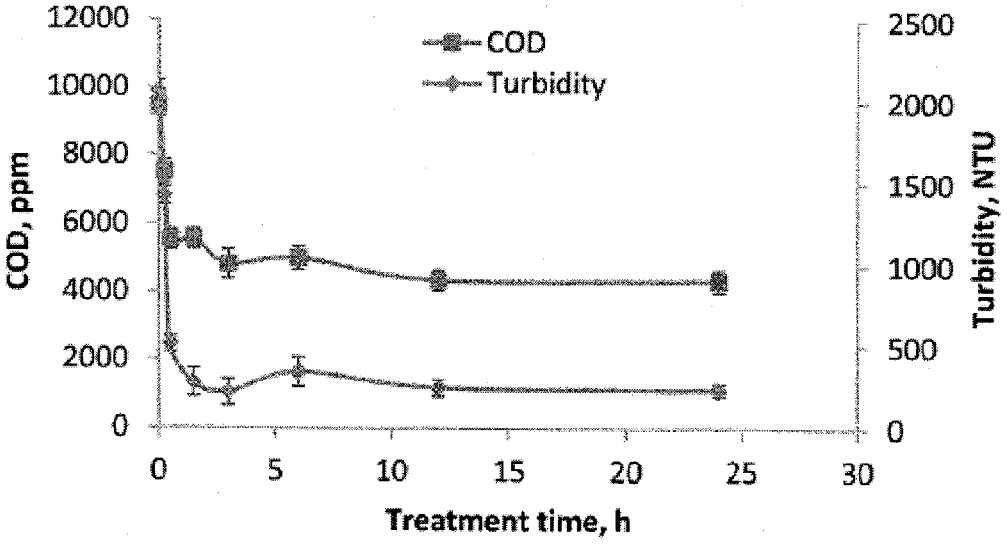

FIG. 3 shows the impact of unwashed fly ash treatment time on lignin, COD and turbidity contents of SL samples. It is observable that lignin reached the saturation level of 67 mg/g adsorption in 3 h. However, COD and turbidity reached the plateau in 45 min and 90 min, respectively. These results are in harmony with earlier study on adsorption of lignin from SL on activated carbon. This hypothesis is in harmony with prior literature results. In the literature, it was claimed that the maximum adsorption of calcium lignosulfonate (34.20 mg/g) onto coal fly ash obtained in 2 h under the conditions of 30° C. and 150 rpm. These results may imply that the coagulation of metals with components of SL was a fast process, while adsorption of lignin on fly ash was a slower process in the overall removal of lignin, COD and turbidity analyses.

2.5. Process Modification

As illustrated in the experimental section, five alternatives were assessed under the optimized conditions (3 h and dosage of 55 mg fly ash per gram of SL) and the experimental data were listed in Table 3. The results showed that a single stage adsorption resulted in 53% of lignin, 49% of COD and 89% of turbidity removals from SL (option A).

However, the pH of sample increased to 12.1, which is unfavorable as biological wastewater treatments are mostly performed at 5-8 pH. Therefore, pH was adjusted before and after incubation in options B and C, respectively, and the results were listed in table 3. As can be seen, the pH adjustment before incubation (option B), caused 53% lignin removal, but the turbidity and COD were less reduced compared with option A. This analysis indirectly implies that lignin removal was somehow independent of pH of the process (adsorption was independent), but the removal of other compounds from SL (via coagulation) was pH dependent. In prior literature, it was reported that the metal-lignocellulosic compounds were more effectively formed under alkaline pH, which indirectly confirms the dependency of coagulation with pH.

In option C, the addition of acid after adsorption slightly improved the removal of lignin and COD, but not turbidity. The small decrease in lignin content of SL is attributed to the adsorption of more lignin on fly ash, which resulted in a further COD reduction. However, addition of acid affects the overall ionic strength of the SL. Under acidic condition, the hydrogen ion will replace the metal ion on the metal-lignocellulosic compounds. The solubility of hydrogen-based compound might be higher than that of metal-based compounds, which resulted in its dissolution in SL after readjusting the pH to 5.3. It should be highlighted that the adsorption of lignin in single-stage adsorption (option A) and single-stage adsorption with post pH adjustment (option C) is similar.

An earlier study showed that a two stage adsorption was a more efficient option than one stage adsorption for lignin removal from SL (lignin removal increased from 45% to 60%). The results of option D depicted that after two stages of adsorption, lignin, COD and turbidity removal were 66%, 68% and 94%, respectively. In this case, the lignin adsorption on fly ash corresponded to 67 mg/g and 17 mg/g in the first and second stages, respectively. In option E, the two stage adsorption was followed by a neutralization step, which led to 68% of lignin, 70% of COD and 94% of turbidity reductions.

TABLE 3

Concentration of Lignin, COD, Turbidity and pH of SL under Different Process Options (Conducted under the Optimal Conditions of 55 mg/g Fly Ash/SL, 3 h and 30° C.).

| Option | Fly ash | Lignin concentration, g/l | COD, mg/l | Turbidity, NTU | End pH |
|---|---|---|---|---|---|
| Control | — | 7.05 ± 0.12 | 9456 ± 510 | 2060 ± 82 | 5.3 ± 0.1 |
| A | unwashed | 3.29 ± 0.09 | 4840 ± 246 | 221 ± 90 | 12.1 ± 0.1 |
| A | washed | 3.45 ± 0.10 | 5100 ± 324 | 758 ± 47 | 10.0 ± 0.0 |
| B | unwashed | 3.32 ± 0.08 | 6085 ± 489 | 620 ± 73 | 5.3 ± 0.0 |
| C | unwashed | 3.06 ± 0.11 | 4508 ± 341 | 301 ± 65 | 5.3 ± 0.1 |
| D | unwashed | 2.37 ± 0.14 | 2985 ± 342 | 126 ± 13 | 12.3 ± 0.2 |
| E | unwashed | 2.28 ± 0.16 | 2873 ± 358 | 121 ± 18 | 7.1 ± 0.1 |

2.6. High Heating Value of Treated Fly Ash

Figure 4:
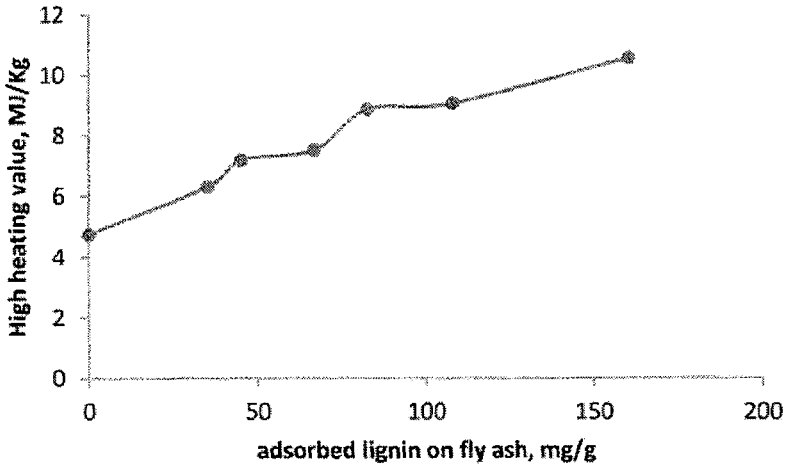
FIG. 4 graphically illustrates notably high heating values of lignocellulose-treated fly ash as a function of lignocellulose adsorption on fly ash.

FIG. 4 shows the calorific value of the fly ash treated with SL in a single adsorption step (option A). As can be seen, an increase in the adsorption of lignin on fly ash escalated the calorific value of the lignocellulosic-treated fly ash. This would indicate that the lignocellulosic-treated fly ash can be introduced as a source of energy in the boiler.

3. Experimental Conclusions

The adsorption of lignin from SL of TMP process via fly ash was investigated. The results suggest that adsorption of lignin on fly ash was insensitive to pH and slow, but the coagulation of other constituents of SL with fly ash components was pH sensitive and fast. Also, decreasing the pH slightly increased the turbidity of SL. The results showed that the adjustment of pH after the treatment was better for COD removal. It was observed that within the optimum condition (fly ash/SL ratio of 55 mg/g for 3 h), 53% of lignin, 49% of COD and 89% of turbidity was removed.

In summary, fly ash from a biomass boiler can be used not only for removing lignin from SL, but also for decreasing the COD and turbidity of SL. The results showed that the maximum adsorption of lignin on fly ash was 67 mg/g by treating SL with fly ash at room temperature for 3 h in one stage adsorption. The results showed that adjusting the pH of adsorption before or after the process had an insignificant influence on the adsorption of lignin, but affected the turbidity of SL. Additionally, the lignin removal was improved from 53% to 68% in a two stage process (rather than one), while the COD and turbidity reductions were increased from 49% to 70% and from 89% to 94%, respectively.

The maximum removals of lignin and COD were achieved via adjusting pH after adsorption while the maximum turbidity removal was obtained without pH adjustment. The process was modified by adding another stage of adsorption and neutralizing the pH. The two stage adsorption process had 68%, 70% and 94% lignin, COD and turbidity removals, respectively.

These results show that the adsorption process with fly ash can be applied to decrease the load of wastewater system of pulping TMP process.

Since various modifications can be made in my invention as herein above described, and many apparently widely different embodiments of same made within the scope of the claims without departure from such scope, it is intended that all matter contained in the accompanying specification shall be interpreted as illustrative only and not in a limiting sense.

REFERENCES (1) Sinclair, W. F., Controlling effluent discharges from Canadian pulp and paper manufacturers. Canadian Public Policy/Analyse de Politiques 1991, 86-105.

(2) Van Heiningen, A., Converting a kraft pulp mill into an integrated forest biorefinery. Pulp Paper Can. 2006, 107, 38-43.

(3) Pokhrel, D.; Viraraghavan, T., Treatment of pulp and paper mill wastewater-a review. Sci. Total Environ. 2004, 333, 37-58.

(4) Humbird, D.; Davis, R.; Tao, L.; Kinchin, C.; Hsu, D.; Aden, A.; Schoen, P.; Lukas, J.; Olthof, B.; Worley, M., Process Design and Economics for Biochemical Conversion of Lignocellulosic Biomass to Ethanol National Renewable Energy Laboratory Report NREL, TP-313 5100-47764, 2011.

(5) Kumar, S.; Mohanty, A.; Erickson, L.; Misra, M., Lignin and its applications with polymers. J Biobased Mat. Bioenergy 2009, 3, 1-24.

(6) Lora, J. H.; Glasser, W. G., Recent industrial applications oflignin: a sustainable alternative to nonrenewable materials. J Polym. Environ. 2002, 10, 39-48.

(7) Kavanagh, J.; Sritharan, S.; Riad, M.; Kollaras, A., Lignocellulosic wastewater treatment. Chemeca 2011: Engineering a Better World: Sydney Hilton Hotel, NSW, Australia, 18-21 Sep. 2011 2011, 1431.

(8) Andersson, K.; Pranovich, A.; Norgren, M.; Eriksson, M.; Holmbom, B., Effects of biological treatment on the chemical structure of dissolved lignin-related substances in effluent from thermomechanical pulping. Nord. Pulp Paper Res. J 2008, 23, 164-171.

(9) Andersson, K. I.; Eriksson, M.; Norgren, M., Lignin removal by adsorption to fly ash in wastewater generated by mechanical pulping. Ind. Eng. Chem. Res. 2012, 51, 3444-3451.

(10) Yu, Y.; Park, B.; Hwang, S., Co-digestion of lignocellulosics with glucose using thermophilic acidogens. Biochem. Eng. J 2004, 18, 225-229.

(11) Liu, T.; He, Z.; Hu, H.; Ni, Y., Treatment of APMP pulping effluent based on aerobic fermentation with "*Aspergillus niger*" and post-coagulation/flocculation. Bioresour. Technol. 2011, 102, 4712-4717.

(12) Yuliani, G.; Chaffee, A. L.; Gamier, G., Biorefinery process water effluent treatments by salt coagulation. Biomass Bioenergy 2013, 56, 189-196.

(13) Zhou, Y.; Liang, Z.; Wang, Y., Decolorization and COD removal of secondary yeast wastewater effluents by coagulation using aluminum sulfate. Desalination 2008, 225, 301-311.

(14) Vinas, M.; Martinez, J.; Baselli, B., Advantages of an anaerobic reactor for TMP wastewater with separated acidogenic and methanogenic stages. Environ. Technol. 1993, 14, 995-1000.

(15) Oveissi, F.; Fatehi, P., Isolating lignin from spent liquor of thermomechanical pulping process via adsorption. Environ. Technol. 2014, 1-24.

(16) Ahmaruzzaman, M., A review on the utilization of fly ash. Prag. in Energy and Combustion Sci. 2010, 36, 327-363.

(17) Yuan, Z.; Cheng, S.; Leitch, M.; Xu, C. C., Hydrolytic degradation of alkaline lignin in hot-compressed water and ethanol. Bioresour. Technol. 2010, 1OJ, 9308-9313.

(18) Fadeeva, V.; Tikhova, V.; Nikulicheva, O., Elemental analysis of organic compounds with the use of automated CHNS analyzers. J Anal. Chem. 2008, 63, 1094-1106.

(19) Yang, K.; Peng, J.; Srinivasakannan, C.; Zhang, L.; Xia, H.; Duan, X., Preparation of high surface area activated carbon from coconut shells using microwave heating. Bioresour. Technol. 2010, 101, 6163-6169.

(20) Liu, Z.; Fatehi, P.; Jahan, M. S.; Ni, Y., Separation of lignocellulosic materials by combined processes of pre-hydrolysis and ethanol extraction. Bioresour. Technol. 2011, 102, 1264-1269.

(21) Dashtban, M.; Gilbert, A.; Fatehi, P., Separation of lignocelluloses from spent liquor of NSSC pulping process via adsorption. J. Environ. Manage. 2014, 136, 62-67.

(22) Fatehi, P.; Shen, J.; Hamdan, F. C.; Ni, Y. H., Improving the adsorption oflignocelluloses of prehydrolysis liquor on precipitated calcium carbonate. Carbohydr. Polym. 2013, 92, 2103-2110.

(23) Furuya, K.; Miyajima, Y.; Chiba, T.; Kikuchi, T., Elemental characterization of particle size-density separated coal fly ash by spectrophotometry, ICP (inductively coupled plasma emission spectrometry), and scanning electron microscopy-energy dispersive x-ray analysis. Environ. Sci. Technol. 1987, 21, 898-903.

(24) Kumar, S.; Upadhyay, S.; Upadhya, Y., Removal of phenols by adsorption on fly ash. J. Chem. Technol. Biotechnol. 1987, 37, 281-290.

(25) Viraraghavan, T.; de Maria Alfaro, F., Adsorption of phenol from wastewater by peat, fly ash and bentonite. J. Hazard. Mater. 1998, 57, 59-70.

(26) Akgerman, A.; Zardkoohi, M., Adsorption of phenolic compounds on fly ash. J. Chem. Eng. Data 1996, 41, 185-187.

(27) Saeed, A.; Fatehi, P.; Ni, Y., Chitosan as a flocculant for pre-hydrolysis liquor of kraft-based dissolving pulp production process. Carbohydr. Polym. 2011, 86, 1630-1636.

(28) Chen, C.-L.; Chang, H.-M.; Kirk, T. K., Carboxylic acids produced through oxidative cleavage of aromatic rings during degradation of lignin in spruce wood by Phanerochaete chrysosporium. J Wood Chem. Technol. 1983, 3, 35-57.

(29) Nakagame, S.; Chandra, R. P.; Kadla, J. F.; Saddler, J. N., Enhancing the enzymatic hydrolysis of lignocellulosic biomass by increasing the carboxylic acid content of the associated lignin. Biotechnol. Bioeng. 2011, 108, 538-548.

(30) Gregory, J.; Duan, J., Hydrolyzing metal salts as coagulants. Pure Appl. Chem. 2001, 73, 2017-2026.

(31) Duan, J.; Gregory, J., Coagulation by hydrolysing metal salts. Adv. Colloid Interface Sci. 2003, 100, 475-502.

(32) Ugurlu, M.; Gurses, A.; Yalcin, M.; Dogar, C., Removal of phenolic and lignin compounds from bleached kraft mill effluent by fly ash and sepiolite. Adsorption 2005, 11, 87-97.

(33) Andersson, K. I.; Eriksson, M.; Norgren, M., Removal of lignin from wastewater generated by mechanical pulping using activated charcoal and fly ash: Adsorption isotherms and thermodynamics. Ind. Eng. Chem. Res. 2011, 50, 7722-7732.

(34) Mohan, S.; Gandhimathi, R., Removal of heavy metal ions from municipal solid waste leachate using coal fly ash as an adsorbent. J Hazard. Mater. 2009, 169, 351-359.

(35) Li, H. Q.; Huang, G. H.; An, C. J.; Zhang, W. X., Kinetic and equilibrium studies on the adsorption of calcium lignosulfonate from aqueous solution by coal fly ash. Chem. Eng. J 2012, 200, 275-282.

(36) Mourant, D.; Wang, Z.; He, M.; Wang, X. S.; Garcia-Perez, M.; Ling, K.; Li, C.-Z., Mallee wood fast pyrolysis: effects of alkali and alkaline earth metallic species on the yield and composition of bio-oil. Fuel 2011, 90, 2915-2922.

(37) Fu, F.; Wang, Q., Removal of heavy metal ions from wastewaters: a review. J Environ. management 2011, 92, 407-418.

The invention claimed is:

1. A method of treating spent liquor from a pulping process of a pulp mill, the method comprising treating spent liquor from a steam pretreatment stage of a thermomechanical pulping process with fly ash obtained from a bark boiler, wherein said fly ash is applied to said spent liquor at a wastewater pretreatment stage upstream from a biological wastewater treatment stage to which the pretreated spent liquor is subsequently subjected.

2. The method of claim 1 comprising, after treatment of the spent liquor with the fly ash, separating said fly ash from the spent liquor and using said ash as a boiler fuel source.

3. The method of claim 1 comprising, after treatment of the spent liquor with the fly ash, separating at least some of the fly ash from the spent liquor and returning the separated fly ash to the same bark boiler from which said fly ash was sourced for use of said separated fly ash therein as a boiler fuel source.

4. The method of claim 2 comprising, after using said separated fly ash as the boiler fuel source, reusing said separated fly ash in an additional spent liquor treatment step.

5. The method of claim 4 comprising applying the separated fly ash to the additional spent liquor treatment step via a recirculation loop of a process flow path of the pulp mill.

6. The method of claim 3 comprising a step of increasing a dryness of the separated fly ash prior to use of the separated fly ash as the boiler fuel source.

7. The method of claim 6 wherein the step of increasing the dryness of the separated fly ash comprises performing a pressing operation on the separated fly ash.

8. The method of claim 1 comprising, after treatment of the spent liquor with the fly ash at the pretreatment stage, applying a second dose of fly ash to the spent liquor at a second pretreatment stage also upstream from the biological wastewater treatment stage.

9. The method claim 8 comprising separating the spent liquor from fly ash prior to the second pretreatment stage.

10. The method of claim 8 wherein all the fly ash, including the second dose thereof, is obtained from said bark boiler.

11. The method of claim 1 comprising reducing a pH level of the spent liquor.

12. The method of claim 11 comprising reducing the pH level of the spent liquor subsequent to treatment thereof with the fly ash at the pretreatment stage.

13. The method of claim 12 wherein reducing the pH level comprises reducing the pH level to an original pH value of that was possessed by the spent liquor prior to the treatment thereof with the fly ash at the pretreatment stage.

14. The method of claim 1 wherein lignin content of said spent liquor at the wastewater pretreatment stage is reduced.

15. The method of claim 1 wherein a chemical oxygen demand of said spent liquor at the wastewater pretreatment stage is reduced.

16. The method of claim 1 wherein a turbidity level of said spent liquor at the wastewater pretreatment stage is reduced.

* * * * *